United States Patent [19]

Nilson

[11] 3,977,577

[45] Aug. 31, 1976

[54] SELF-CLOSING CLOSURE

[75] Inventor: Billy Nilson, Mjolby, Sweden

[73] Assignee: KeNova AB, Malmo, Sweden

[22] Filed: July 23, 1975

[21] Appl. No.: 598,199

Related U.S. Application Data

[63] Continuation of Ser. No. 387,160, Aug. 9, 1973, abandoned.

[52] U.S. Cl. ..... 222/499

[51] Int. Cl.[2] ..... B65D 5/72

[58] Field of Search ..... 222/525, 494, 497, 498, 222/499

[56] References Cited

UNITED STATES PATENTS

| | | | |
|---|---|---|---|
| 1,940,706 | 12/1933 | Aufricht | 222/499 |
| 3,807,608 | 4/1974 | Nilsson | 222/521 |

*Primary Examiner*—Stanley H. Tollberg

*Attorney, Agent, or Firm*—Finnegan, Henderson, Farabow & Garrett

[57] ABSTRACT

A self-closing closure for use with a container, the closure opening automatically upon the application of opening pressure to the contents of the container and being self-closing upon the release of pressure. A pair of resilient discs or diaphragms are employed which in the closed position have their convex surfaces facing each other. One of these discs carries the valve opening and the other disc supports the valve stem which projects into and seals the opening in the closed position of the closure. Upon the application of opening pressure to the container contents, the resilient discs move axially of the closure and the convex surfaces change to concave surfaces. The valve stem is drawn away from the opening. The large axial movement of the discs is attained with minimal pressure yet secures a large opening area for dispensing the contents.

10 Claims, 2 Drawing Figures

SELF-CLOSING CLOSURE

This is a continuation of application Ser. No. 387,160, filed Aug. 9, 1973 now abandoned.

BACKGROUND OF THE INVENTION

This invention relates to a self-closing closure for tubes and other containers in which the pressure in the container may be manually varied, preferably by squeezing the container to a less or greater extent. More specifically, the invention relates to a closure in which said pressure variation causes automatic opening of the closure.

A known closure of this kind has a bellows shape and comprises two suitably disc-shaped members connected to each other along the outer portions thereof. The inner portions of the members together form a valve device in which a dowel connected to the first member operates as a stop valve against an opening serving as a valve seat in the second member. In such closure the concave sides of the disc-shaped members face each other.

Said previously known closure operates well, especially when dispensing relatively thin flowing substances but is less suitable in the case of higher-viscosity substances because the required opening pressure is relatively high.

SUMMARY OF THE INVENTION

The primary object of the invention is to provide an improved self-closing closure having the characteristic of opening and more easily thereby being able to operate in response to lower pressures while at the same time maintaining the effectiveness of the closure.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the container of this invention comprises first and second members mutually connected at their peripheries, said first member having a first flexible, resilient surface and a projection extendings therefrom, said second member having a second flexible, resilient surface with a dispensing opening, said projection of said first member extending toward said opening in said second member and closing said opening when said closure is in the closed position, each of said flexible, resilient surfaces having in the closed position of said closure a convex shape which faces toward the convex shape of the other surface, each of said surfaces having in the open position of said closure a concave shape which faces toward the concave shape of the other surface, said convex surfaces changing to concave surfaces upon the application of opening pressure to the contents of the container to withdraw said projection of said first member in relation to said opening of said second member to open the closure and permit the dispensing of the contents from the container, said concave surfaces returning to convex surfaces automatically upon the release of opening pressure, thereby to close said closure.

BRIEF DESCRIPTION OF THE DRAWINGS

The accompanying drawing illustrates a preferred embodiment of the invention in which.

DESCRIPTION OF THE PREFERRED EMBODIMENT

Figure 1:
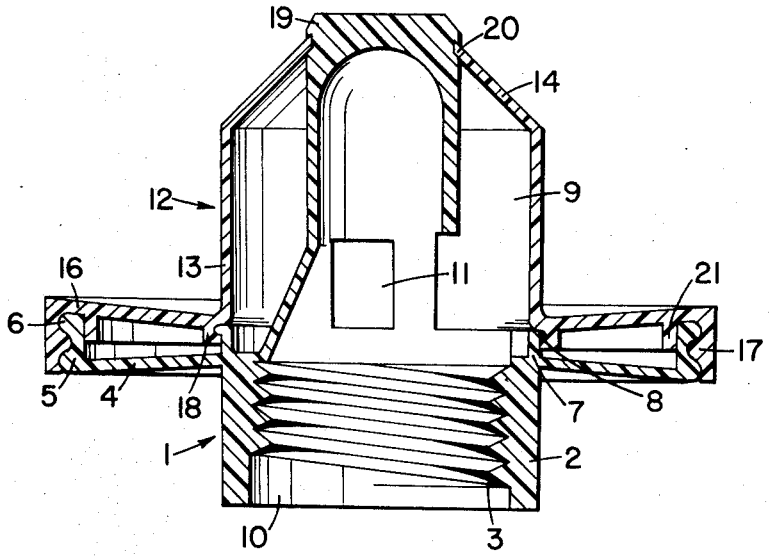
FIG. 1 is a cross-sectional view of the closure in a locked transport.
Figure 2:
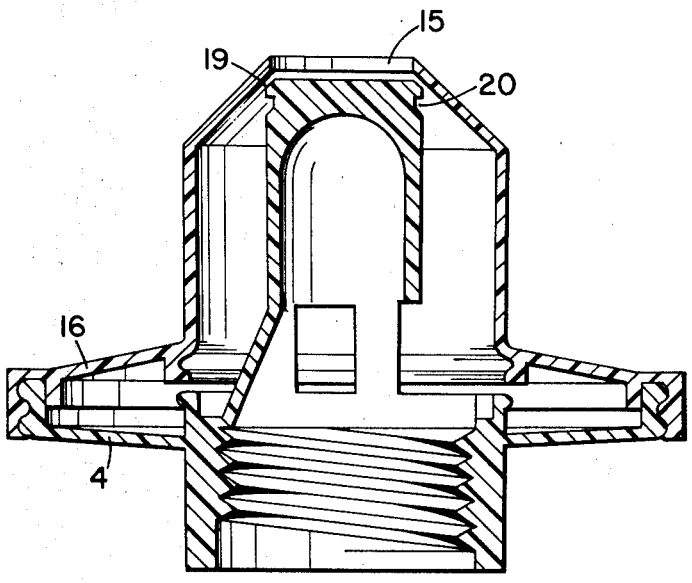
FIG. 2 is a view similar to FIG. 1 showing the closure in the dispensing position.

With reference now to the preferred embodiment illustrated in FIGS. 1 and 2, the closure consists of two members connected to each other by a snap fit. One of these members, designated a reference numeral 1, and the second member 12, are both preferably made from a relatively rigid but thin-walled plastic material in an injection molding process.

Member 1 has a central sleeve-shaped portion 2, having a bore 10 which preferably is threaded to connect the closure to a flexible tube or similar container (not shown). A disc-shaped part 4 extends from the sleeve-shaped portion and, as can be seen in FIG. 1, is inclined in an unbiased position so that the outer portion thereof is positioned at a lower level than the inner portion thereof. Said disc-shaped part terminates in an outer flange 5 extending substantially parallel to the dispensing direction. One or more outwardly-directed peripheral beads 6, are formed on flange 5. The disc-shaped part 4 does not extend from the upper end of the sleeve 2, but extends from the sleeve somewhat below said end, whereby the sleeve 2 has a substantially cylindrical extension 7. The upper end of sleeve extension 7 has an outwardly-directed peripheral bead or rim 8 or alternatively can be undercut.

A dowel or projection 9, defining one of the valve elements, extends upwardly from the sleeve 2 at the junction with extension 7. The bore 10 formed in sleeve 2 is formed also in dowel 9 but does not run through the dowel. The bore 10 communicates with the interior of the container (not shown). Side openings 11 are formed in the dowel and permit communication between the interior of the container and the interior of the second member 12.

The second member has, similar to the construction of the aforedescribed first member, a substantially sleeve-shaped central portion 13 terminating in a conical part 14 tapering inwardly. An upper opening 15 is formed in the sleeve-shaped portion and defines the other valve element. A disc-shaped part 16 extends from the central portion 13, and has at its outer portion a peripheral rim or flange 17 designed to receive the bead or beads 6 of the first member 1. According to FIG. 1, said disc-shaped part 16 has the outer portion thereof positioned at a higher level than the inner portion thereof and is either curved or inclined. Connected approximately to the junction between the sleeve-shaped portion 13 and the disc-shaped part 16 are coupling means 18 intended to receive the bead or rim 8 of the first member 1. As can be seen in FIGS. 1 and 2, coupling means 18 is formed as a bead or rim which overlaps bead or rim 8. Said coupling means may also comprise a downwardly converging annular flange.

As can be seen in FIG. 1, the two disc-shaped parts of the first and second members in the initial position have their convex sides facing each other. The two disc-shaped parts are made with a thin wall and they are consequently, relatively flexible. The rims or flanges 5 and 17 at the periphery of the disc-shaped parts 4 and 16, respectively, assume a preferably cylindrical shape having an axial extension exceeding the axial extension of the inner portions of such disc-shaped parts.

As can additionally be seen in FIG. 1, the dowel 9 has an upper conical end surface 19 and the angle which this surface forms with the horizontal plane is greater than the angle of the conical part 14. Hereby, an extremely effective sealing is obtained between the dowel and the portion of the part 14 surrounding the dispensing opening 15 when the dowel is in its normal operative position as a closed valve. To this end the conical part 14 may suitably be obliquely cut so that it forms a sealing lip.

The closure described above operates in the following manner.

In the position shown in FIG. 1 the closure is in a locked condition to prevent closure opening, and this locked condition can be used during distribution and storage of the goods in the container (not shown). In locking the closure, the sleeve-shaped portion 13 of member 12 is pressed against member 1 so that the coupling means 18 receives the bead 8. Alternatively, locking may also be achieved by forming the dowel 9 of member 1 with a cut 20 into which the edge portion surrounding the dispensing opening 15 snaps. In this locked position of the closure, it is possible to squeeze the pack or container containing the goods without dispensing the content thereof. Concerning the members 8 and 18, it should be noted that in the locked position of the closure, these serve to isolate the center part of the closure, as defined by the interior of sleeves 2, 13 and the dowel 9, from the space defined by the walls 4 and 16 and flange 5. Hereby, a pressure exerted upon the container is effectively prevented from acting upon the walls 4 and 16, which normally serve as a diaphragm. It should be understood that the members 7, 8 and 18 need not be designed as interlocking elements but may comprise annular flanges which in the position shown in FIG. 1 sealingly overlap each other.

When it is desired to prepare the closure for dispensing the sleeve 13 is moved in a direction away from the member 1 to unlock the members 14 and 20 and 8 and 18. In this position, not shown, the disc-shaped part 16 forms an acute angle with the horizontal plane, i.e., the outer portion thereof is still positioned at a higher level than the inner portion thereof. The angle observed as being the most suitable amounts to 10° – 15°. When thereafter the interior of the container (not shown) is subjected to a pressure as by deforming the container, the contents of the container will be fed into the space between the disc-shaped parts 4 and 16. The pressure exerted by contents against the inner surface of said discs cause the discs to move in a direction away from each other. The disc shaped parts will each change from the angular position shown, previously referred to as an acute angle, to the angle nil, and thereafter to a position in which the discs assume a slightly positive angle. By this mutual displacement of the two discs, the sleeve 13 will be moved upwardly in relation to the dowel 9 and dispensing ocurrs through the opening 15, now exposed. The angular change of the resilient disc-shaped parts through the angle zero and the resulting long axial displacement of the valve elements provides an extremely easy opening movement requiring a very small pressure change for closure operation and therefore well suited for dispensing substances of widely varying viscosities. When pressure is released, the two disc-shaped parts automatically return to their original position and the closure is closed.

The best performance is achieved if the discs 4 and 16 are both approximately equally flexible and there are flexible or elastic transitions to the central portions.

It may be pointed out that a sealing flange, such as the annular, downwardly-directed, short flange 21, may extend from the disc-shaped part 16 toward disc 4 and be positioned in such a manner that the outer surface thereof engages the inner surface of the flange 5. In addition to providing increased sealing, flanges 21 may also assist in further securing the snap connection of member 1 and 12.

It will be apparent to those skilled in the art that various modifications and variations could be made in the closures of the invention without departing from the scope or spirit of the invention.

I claim:

1. A closure adapted for use with a container, the closure automatically opening in response to pressure upon the contents of the container, and being self-closing upon the release of pressure, said closure comprising first and second members mutually connected at their peripheries, said first member having a first flexible, resilient surface and a projection extending therefrom, said second member having a second flexible, resilient surface with a dispensing opening, said projection of said first member extending toward said opening in said second member and closing said opening when said closure is in the closed position, each of said flexible, resilient surfaces having in the closed position of said closure a convex shape which faces toward the convex shape of the other surface, each of said surfaces having in the open position of said closure a concave shape which faces toward the concave shape of the other surface, said convex surfaces changing to concave surfaces upon the application of opening pressure to the contents of the container to withdraw said projection of said first member in relation to said opening of said second member to open the closure and permit the dispensing of the contents from the container, said concave surfaces returning to convex surfaces automatically upon the release of opening pressure, thereby to close said closure.

2. A closure as claimed in claim 1 wherein said first, flexible, resilient surface comprises a first, disc-shaped part and said second, flexible, resilient surface comprises a second disc-shaped part, and said second member further comprises a sleeve connected at the center of said second, disc-shaped part, said dispensing opening being formed at the top of said sleeve.

3. A closure as claimed in claim 1, further comprising a first flange connected to the periphery of said first, disc-shaped part and a second flange connected to the periphery of said second, disc-shaped part, said flanges extending toward each other, and means formed on said flanges for connecting said disc-shaped parts together and thereby said first and second members.

4. A closure as claimed in claim 3 wherein said first member further comprises a second sleeve connected at the center of said first, disc-shaped part designed to connect the closure to a container, said projection being connected to said second sleeve.

5. A closure as claimed in claim 4 wherein said projection is hollow and further comprising openings formed in said projection to permit communication between the interior of the container and the interior of said first member.

6. A closure as claimed in claim 1 further comprising means formed on said first and second members for locking said closure against operation.

7. A closure adapted for use with a container, the closure automatically opening in response to pressure upon the contents of the container, and being self-closing upon the release of pressure, said closure comprising first and second members mutually connected at their peripheries, said first member having a first flexible, resilient surface and a projection extending therefrom, said second member having a second flexible, resilient surface with a dispensing opening, said projection of said first member extending toward said opening in said second member and closing said opening when said closure is in the closed position, each of said flexible, resilient surfaces having in the closed position of said closure a convex shape which faces toward the convex shape of the other surface, each of said surfaces having in the open position of said closure a concave shape which faces toward the concave shape of the other surface, said convex surfaces changing to concave surfaces upon the application of opening pressure to the contents of the container to withdraw said projection of said first member in relation to said opening of said second member to open the closure and permit the dispensing of the contents from the container, said concave surfaces returning to convex surfaces automatically upon the release of opening pressure, thereby to close said closure, an annular wall formed on one of said first and second members and extending toward said other member, and means formed on the other of said first and second members for engaging said annular wall to form a partition within said closure and lock said closure to prevent opening thereof.

8. A self-closing closure for containers such as tubes and the like in which the pressure within the container may be manually varied preferably by squeezing the container to a smaller or greater extent, comprising two thin, resilient, conical, disc-shaped parts being deformable under influence of said pressure, a pair of relatively rigid annular members, each of said disc-shaped parts extending from and being integral with one of said relatively rigid annular mmembers, said annular members being sealingly connected to each other, one of said disc-shaped parts having in the central portion thereof a dispensing opening, the other of said disc-shaped parts having in the central portion thereof a projection normally closing said dispensing opening, said disc-shaped parts extending obliquely inwards from said annular members, said annular members having an axial extension and arranged relative to each other such that said conical disc-shaped parts in the closed position of the closure have their convex surfaces facing towards each other.

9. A self-closing closure as claimed in claim 8 wherein said two disc-shaped parts in the central portions thereof have annular walls directed towards each other, said annular walls in the transport or storing position of the closure engaging each other by movement of two disc-shaped parts of said closure towards each other past the closed position of the closure, said annular walls thereby forming a partition preventing communication between the central portion of the closure and the outer portion thereof.

10. A self-closing closure for containers such as tubes and the like in which the pressure within the container may be manually varied preferably by squeezing the container to a smaller or greater extent, comprising two thin and resilient disc-shaped parts being deformable under influence of said pressure, one of said parts in the central portion thereof having a dispensing opening, the other of said parts in the central portion thereof having a projection normally closing said dispensing opening, said disc-shaped parts extending obliquely inward from a relatively rigid, preferably cylindrical member having an axial extension exceeding the axial extension of the inner portions of said parts, said disc-shaped parts being conical and in the closed position of the closure having their convex surfaces facing towards each other, said cylindrical member being formed at the outer portion of said disc-shaped members and being provided with beads and grooves engaging each other so that the disc-shaped parts may be securely snapped to each other, the outer portion of the one disc-shaped part having said grooves which are positioned outside of and engaging the beads in the outer portion of the other disc-shaped part, and further comprising an annular sealing flange formed adjacent the outer portion of said one disc-shaped part and directed towards the other disc-shaped part, said flange being positioned to engage the inner surface of the outer portion of the other disc-shaped part.

* * * * *